US006061919A

United States Patent [19]

Reichert

[11] Patent Number: 6,061,919

[45] Date of Patent: May 16, 2000

[54] RANGE FINDER ARCHERY SIGHT

[76] Inventor: Gary R. Reichert, 331 Chestnut Ridge La., Harrisburg, Pa. 17112

[21] Appl. No.: 09/064,903

[22] Filed: Apr. 23, 1998

[51] Int. Cl.[7] ..... F41G 1/467

[52] U.S. Cl. ..... 33/265; 124/87

[58] Field of Search ..... 33/265; 124/87; 356/21

[56] References Cited

U.S. PATENT DOCUMENTS

| | | | |
|---|---|---|---|
| 2,545,454 | 3/1951 | Fredrickson | 33/265 |
| 2,767,472 | 11/1956 | Kocur | 33/265 |
| 2,811,894 | 11/1957 | Braker | 356/21 |
| 3,521,362 | 7/1970 | Duplechin | 33/265 |
| 3,666,368 | 5/1972 | Sprandel | 356/21 |
| 4,995,166 | 2/1991 | Knemeyer | 33/265 |
| 5,117,804 | 6/1992 | Jörlöv | 124/87 |
| 5,511,317 | 4/1996 | Allen | 33/265 |
| 5,561,910 | 10/1996 | Maynard | 124/87 |
| 5,651,185 | 7/1997 | Vanderheyden et al. | 33/265 |
| 5,718,215 | 2/1998 | Kenny et al. | 33/265 |
| 5,920,996 | 7/1999 | Hurckman et al. | 33/265 |

*Primary Examiner*—G. Bradley Bennett
*Attorney, Agent, or Firm*—William B. Noll

[57] ABSTRACT

Disclosure relates to an effective, yet inexpensive range finder and sight guide for an archer's bow, particularly for hunting of game, such as deer. The device thereof includes a frame, removably mounted to the archer's bow, having a pair of vertically oriented guide rails for slidably receiving a slide member. A pair of pivotal arms are rotatably mounted to the slide member, where each arm fixedly mounts a horizontally disposed range pin. By manually adjusting the slide member, the respective range pins may be moved closer or farther apart to accurately define the intended game target. Further included is a horizontally disposed sight pin, fixedly secured to the slide member, that remains intermediate to and parallel with the range pins irrespective of the vertical position of the slide member.

9 Claims, 4 Drawing Sheets

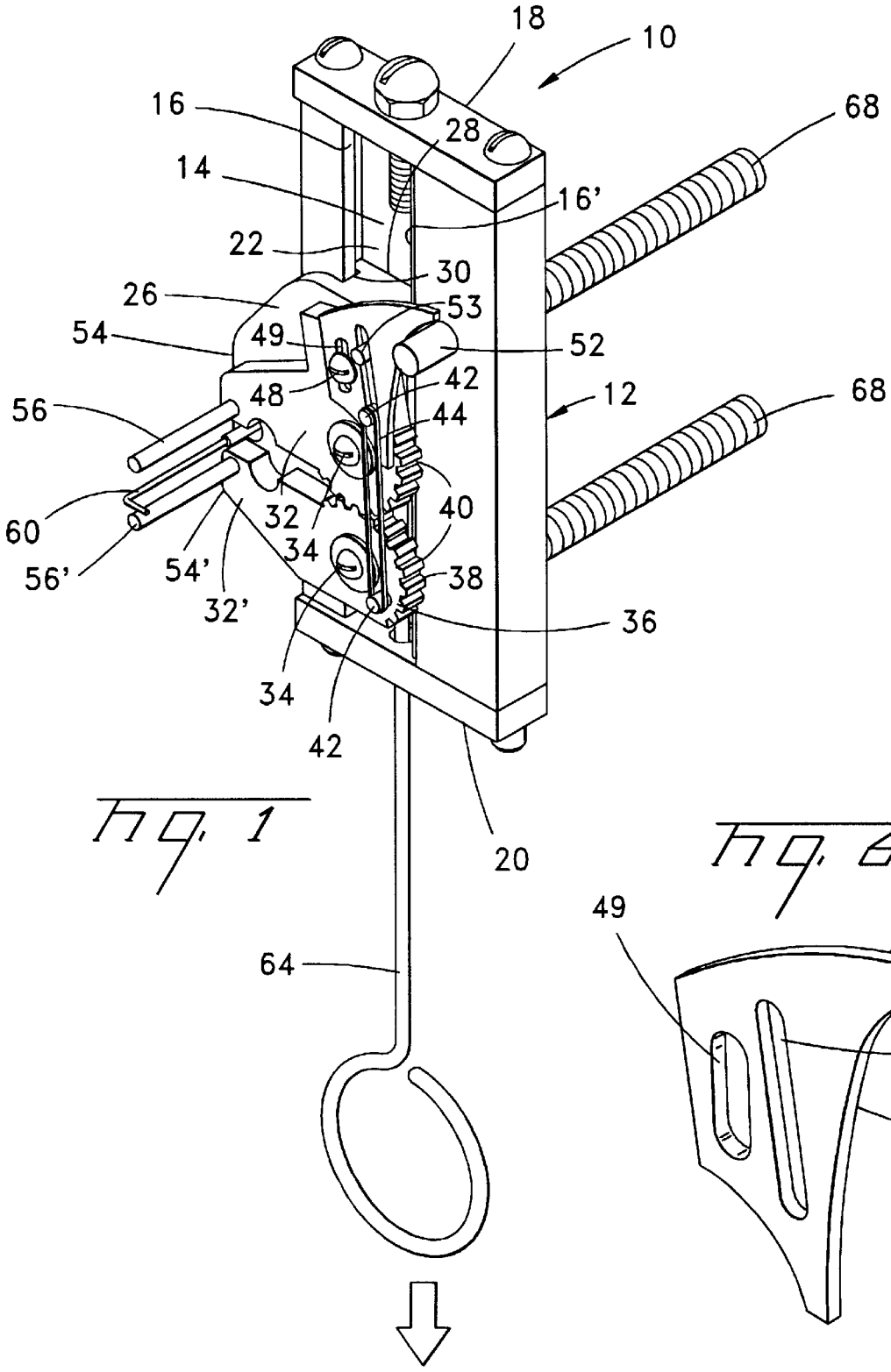
Fig. 1
Fig. 6
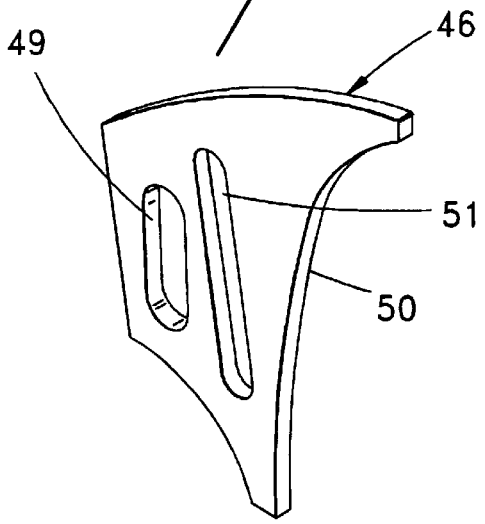

RANGE FINDER ARCHERY SIGHT

FIELD OF THE INVENTION

The present invention is directed to the field of adjustable range finder and archery sights for attachment to an archer's bow, such as may be used to improve one's hunting skills.

BACKGROUND OF THE INVENTION

This invention relates to a range finder and archery sight guide for mounting to the bow of an archer to improve his aim and the prospects for bagging a "kill", such as a deer.

There have been numerous attempts, as exemplified by the following prior art, to provide assistance to hunting game with a bow and arrow, particularly as to a combination bow sight and range finder. However, before reviewing such prior art, it may be helpful to examine the construction and nomenclature relating to hunting bows. Briefly, hunting bows, such as manufactured by Hoyt USA, Salt Lake City, Utah, by way of example, are manufactured of light weight metals and non-metals, and generally comprise an elongated central riser member having a pair of arcuate shaped limbs extending along a common plane therefrom. The respective free ends of the limbs each include a cam wheel through which the bow string is threaded, where the purpose thereof is to give improved let-off, as high as 75%, and draw length adjustability. Intermediate the riser member is an arrow rest with a hand grip positioned therebelow. As a further feature of the riser member, above the arrow rest, a pair of apertures are provided to mount a range finder and/or sight guide for the archer. The present invention was developed to provide an accurate range finder and sight for mounting to the riser member of a conventional bow.

Turning now to the prior art, U.S. Pat. No. 2,767,472, to Kocur, represents an early effort in providing range/sight assistance. The device thereof includes a pair of brackets mounted to the bow, just above the grip member, one forwardly, which is identified as a sight component, the other rearwardly of the bow, where the latter is identified as a range finder, and a range scale associated with the range finder. The range finder includes a manually and slidably adjustable spanning bar which may be frictionally secured along a vertical rod. The range finder, extending laterally from the bracket, includes a plurality of bead sights, preferably in the form of threaded screws, engaging a vertically oriented bar of the bracket. The respective beads and range-related bands of the range scale are colored alike in accordance with the translational code from top to bottom successively in sharply contrasting colors. A locknut is provided on the end of each bead sight opposite to the head, or bead, for locking abutment against the corresponding end of the slide in which the bead sight is fitted to secure the sight in horizontally adjusted position.

A later attempt for an archery sight and range finder is described in U.S. Pat. No. 3,666,368, to Sprandel. The system, as disclosed therein, consists of an attachment having a vertical slide on which two sliders are vertically movable. The sliders have parallel, horizontal sight bars, and when moved in spaced relation, enable the archer to sight the game between them. One sight bar also has a bull's-eye sight, to zero-in on the body of the game. A pivoted finger piece on the slide can be manually adjusted, and is connected to the sliders in such a manner as to not only vertically adjust the latter but also to automatically vary the spacing between them, this being accomplished by links between the finger piece and sliders. Game which is far away and appears small, requires close spacing of the sight bars which results in their being automatically positioned vertically to a lower level, together with the bull's-eye sight, so as to provide for a higher trajectory of the arrow, and vice versa.

U.S. Pat. No. 4,995,166, to Knemeyer, illustrates a more recent version of a range finder and sight for an archery bow. The device, thereof, includes a support bracket mountable on the handle portion of an archery bow, an upright frame carried by the support, and a carriage or slide movable vertically along the upright frame. The carriage or slide carries a horizontally disposed sight pin having an end portion in the form of a sight bead to be aligned with the target, and a pair of range pins. The slide has mechanism for moving the range finder pins equally toward the sight pin or away from it as the slide is moved. The amount of increase or decrease in the spacing between the range finder pins for a given length of travel of the slide can be adjusted and can be different for different ranges of vertical travel of the slide.

SUMMARY OF THE INVENTION

The present invention is directed to an inexpensive, yet effective range finder and archery sight that may be used by archers, mounted to their bow, in hunting game. The device hereof comprises a frame having a pair of vertically oriented guide members for slidably receiving a slide member therebetween. Secured to and rotatably mounted on the slide member are a pair of pivotally mounted arms which operate to open and close as the slide member moves vertically between the guide members. The pivotal arms, each mounting a fixed range pin which cooperate to define the game target, are rotatable movable through a camming member to increase or decrease the spacing between the respective range pins. Additionally, a sight pin is securely fixed to the slide member and remains intermediate the range pins whether extended or restricted through movement of the slide member. Finally, manual means are provided to move the slide member to set the range pins, as desired, to define the target.

Accordingly, an object of this invention is to provide an effective, integrated range finder and archery sight for a bow, where the simplicity of construction renders the device inexpensive and available for broad use.

Another object of this invention is the provision of a readily mountable range finder and archery sight for an archer's bow.

A further object hereof is the provision of an effective manually operated range finder and archery sight that may be quickly adjusted for large or small game.

Still another object of this invention lies in the flexibility afforded an archer by the use of different and selected camming chip members to customize the bow to his personal preferences to accomodate bow and arrow combinations for the game being hunted.

These and other objects will become apparent to those skilled in the art, such as archery hunters, upon reading these specifications, particularly when read in conjunction with the accompanying drawings.

BRIEF DESCRIPTION OF DRAWINGS

FIG. 1 is a perspective view of the range finder archery sight according to the present invention.

FIG. 6 is a perspective view of an exemplary cam chip that is mounted to the device hereof, where said cam chip is designed and shaped for the type of game being hunted, such as deer, wild turkey, etc.

DETAILED DESCRIPTION OF PREFERRED EMBODIMENT

Figure 2:
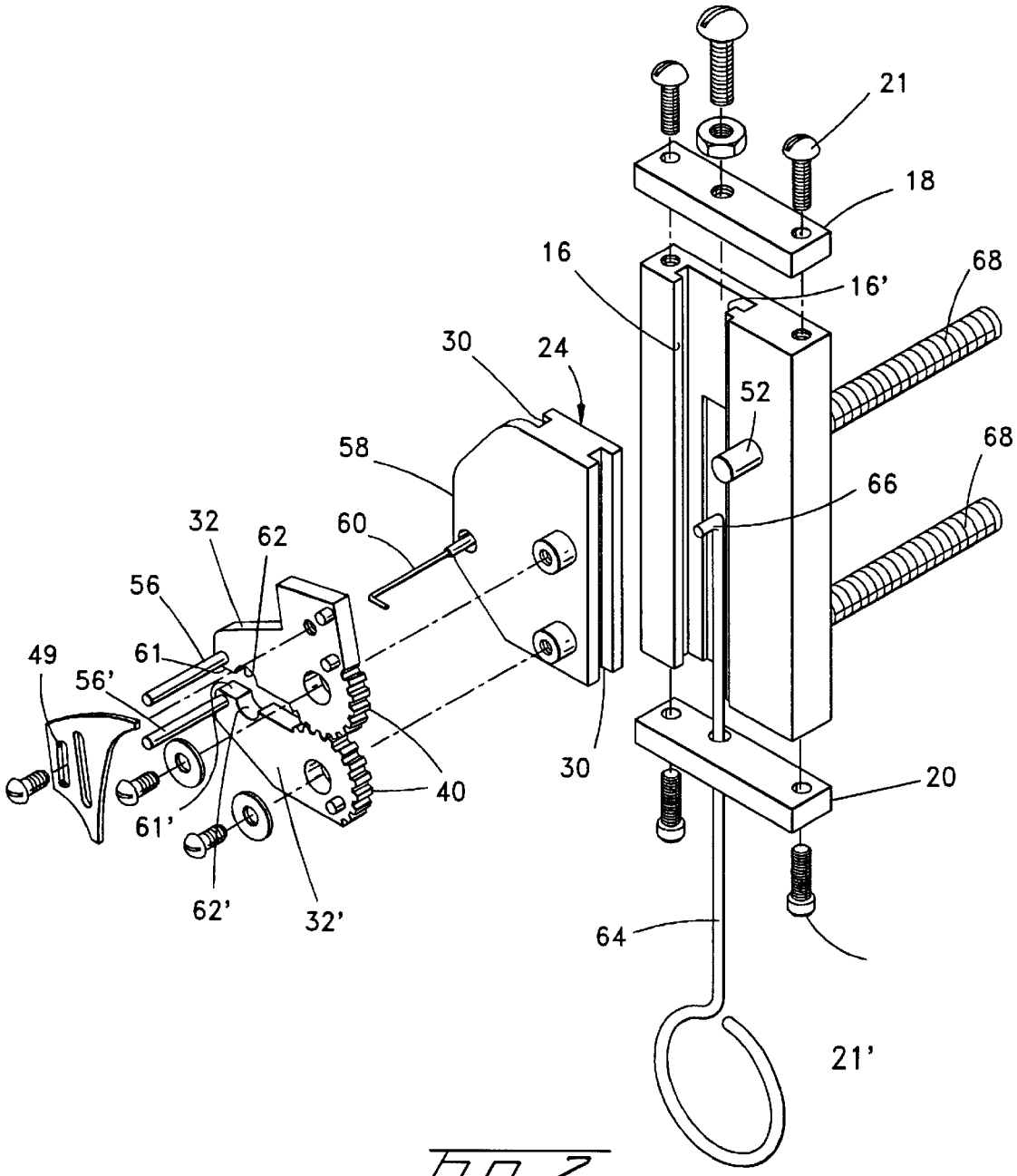
FIG. 2 is an exploded perspective view of the range finder archery sight of FIG. 1.
Figure 3:
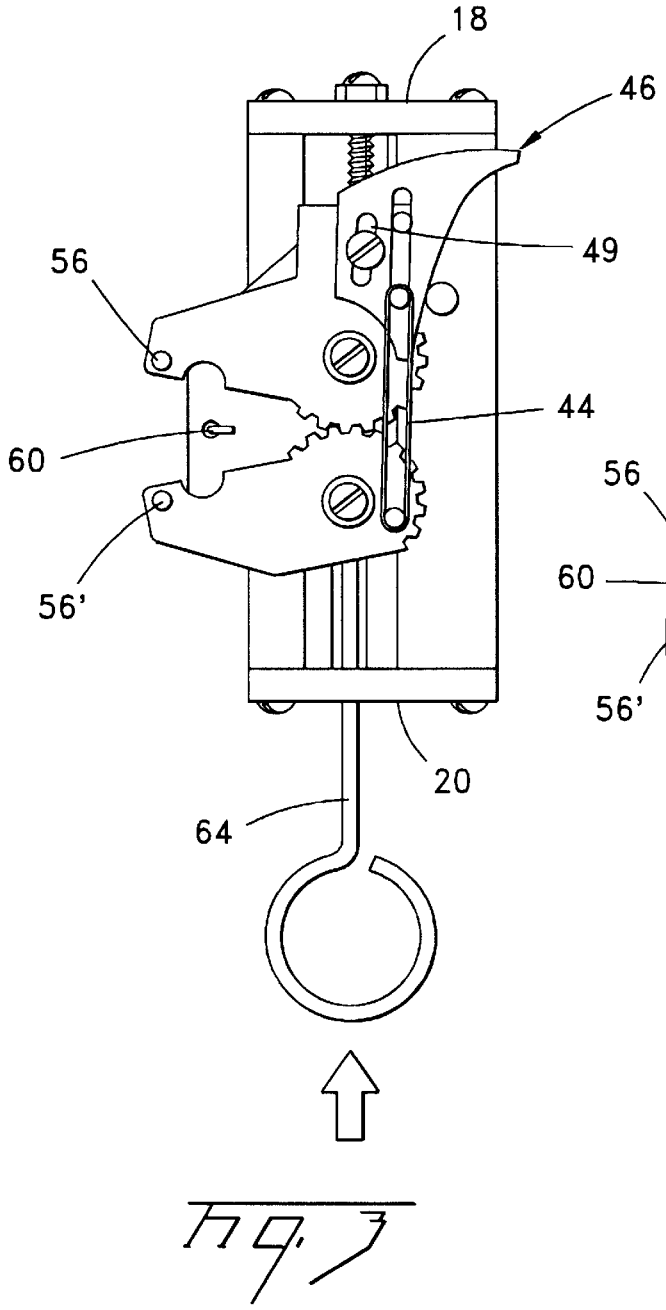
FIG. 3 is a side view illustrating a position for the range finder archery sight of this invention, for a close target, and the manner for adjusting for such target.
Figure 4:
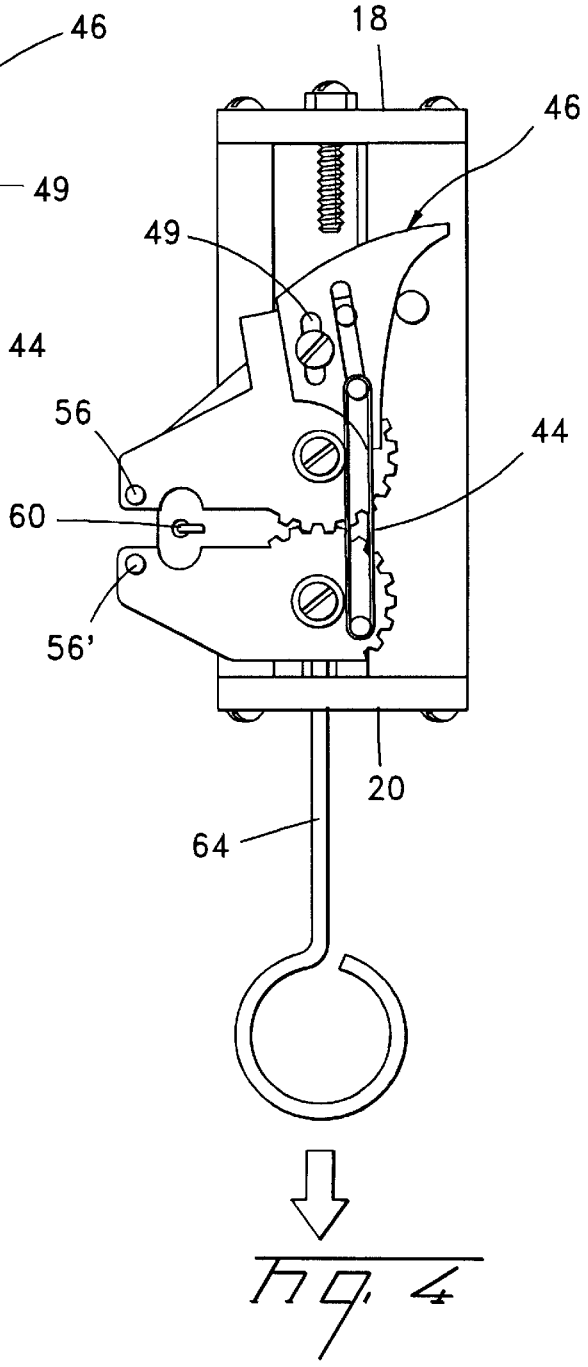
FIG. 4 is a side view, similar to FIG. 3, for a more distant target, where the respective range pins are closer together.

This invention relates to a range finder and archery sight for mounting to an archer's bow to help zero-in on the range and target the desired game. A preferred embodiment is illustrated in the various views, where like reference numerals denote like parts or features throughout the different views.

Turning now to to the several Figures, FIGS. 1 and 2 show the assembled and disassembled device hereof, respectively, where the latter Figure shows the several components in an exploded fashion. The range finder and archery sight device 10 of this invention comprises a frame 12 having an elongated base 14 mounting a pair of spaced-apart rails or guides 16, 16', a top 18 and bottom 20 secured to the base 14, by fastening members 21, 21', respectively, whereby such assembled components define an elongated slot 22, see FIG. 1, for reasons to become apparent hereafter. The elongated base 14 and rails 16, 16' may be intergrally formed, such as by extruding aluminum, magnesium, and alloys thereof, or plastic, so long as there is access to the slot 22 through the top 18 or bottom 20.

The purpose of the slot 22 is to slidably receive slide member 24 consisting of an essentially planar face member 26 integrally formed on a base 28, with the parallel slots 30 therebetween dimensioned to slidably engage the spaced-apart rails 16, 16'. Mounted for rotative or pivotal motion on the planar face member 26 are a pair of pivotal arms 32, 32' secured by pivot pins 34. Each such arm 32, 32' is essentially "kidney" shaped having a first circular end 36 for mounting by pins 34 to the face member 26, where the circular peripheral edge 38 is preferably provided with plural gear teeth 40, or other suitable means to effect the coordinated movement of the respective pivoting arms. As best seen in FIG. 1, the arms 32, 32' are vertically aligned and mounted so that the respective gear teeth intermesh. By this preferred arrangement, for example, as the upper arm 32 is pivoted in a clockwise manner, the lower arm 32' is comparably pivoted in a counter clockwise manner. Briefly then, the respective arms 32, 32' operate like a pair of jaws, opening and closing by movement of the slide member 24, either up or down, in a manner, including a camming mechanism, to be described hereafter. Finally, each said arm 32, 32' may be provided with an upstanding post 42 to which a biasing element 44, such as a spring or elastomeric member, is attached, the function of which will become apparent in the further description.

The slide member 24 is further provided with a replacable, planar camming chip 46, having means, such as a pin 48 for temporarily securing same to the upper arm 32, where the camming chip may be vertically adjusted along slot 49. This simple adjustment adds to the versatility of the integrated range finder and archery sight hereof by allowing the archer to personalize his bow to changes in arrow weight, such as aluminum to a lighter material, i.e. graphite, and bow rating. Further flexibility, as will be explained later, lies in the use of different camming chips. Briefly, the purpose of the replacable chip is to allow the archer to change such chip to reflect the type of game being hunted, whether it be a large animal like a deer, or smaller, like a rabbit or wild turkey. In any case, the chip 46 is characterized by a camming surface 50 that works in concert with the 20 camming guide 52, secured to the slide member 24. As the slide member is caused to move up or down within the slot 22, by means later described, the camming surface rides against the camming guide to effect opening or closing of the arms 32, 32', as the case may be. The camming chip 46, as best illustrated in FIG. 6, includes a slot 51, that is in sliding engagement with pin 53 extending from upper arm 32, and further receives pin 42. Alternatively, a camming slot in the body of the camming chip may be used rather than the edge or camming surface 50.

A purpose of the invention is to provide not only a sighting means, but offer the archer a means for setting the range to the target, and hence the trajectory of the arrow. To accomplish this purpose, each arm 32, 32', at its free end 54, 54', is provided with a laterally projecting pin 56, 56', parallel to each other, which together function to define the target, see FIG. 5, where a further explanation will be offered later in regard to an review of FIG. 5. Additionally, in close proximity to the side edge 58 of slide member 24, adjacent the guide rail 16, a laterally projecting sight pin 60 is secured to the slide member 24. This is the sighting guide for the archer, and irrespective of the spacing between the pins 56, 56', the sight pin 60 will occupy a position intermediate and parallel to said pins 56, 56'. To facilitate a closing of the arms 32, 32', without interfering with the sight pin 60, the facing edges 61, 61' of the pivotal arms may be provided with off-sets 62, 62' to override the position of the sight pin 60.

Figure 5:
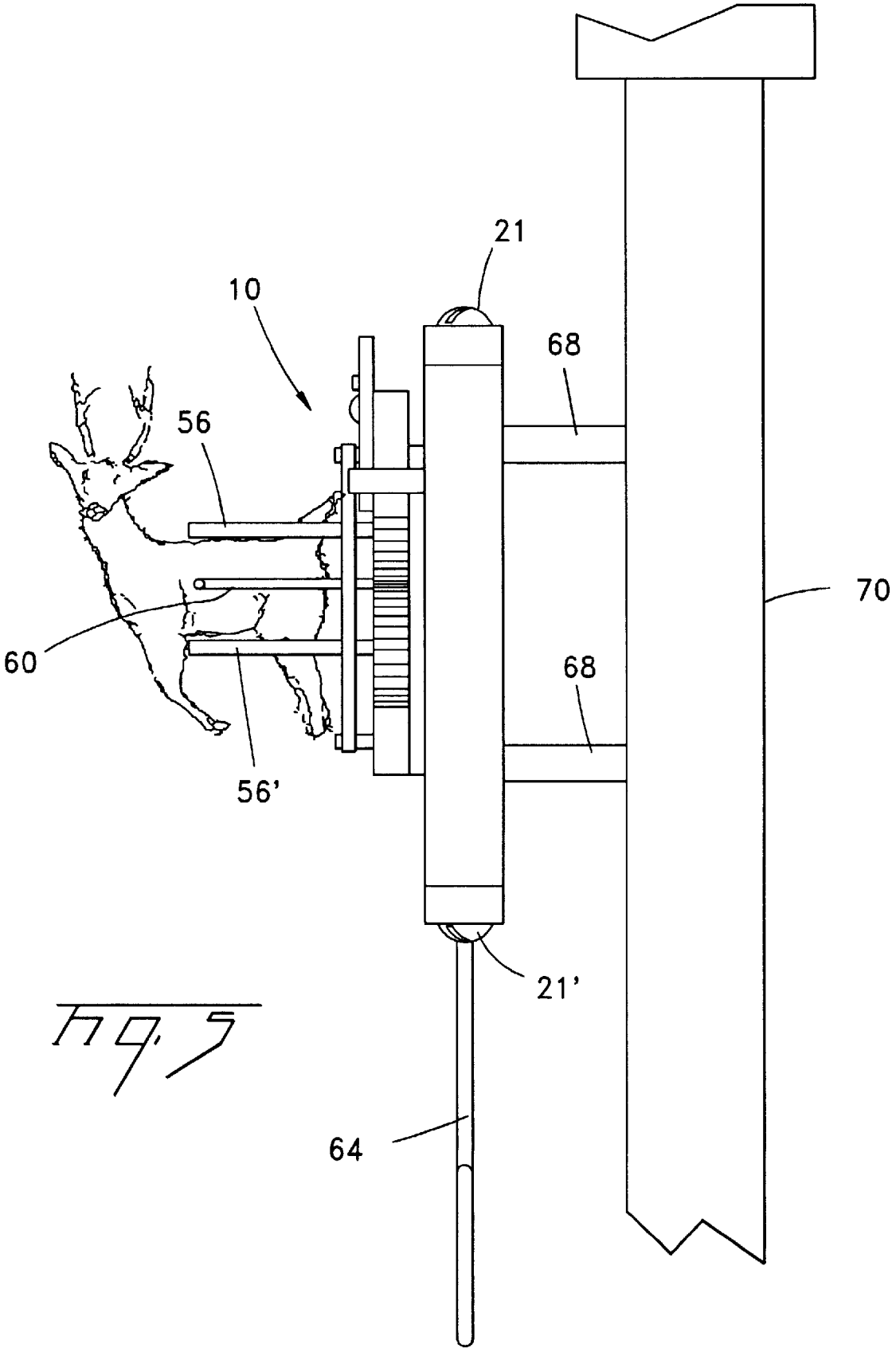
FIG. 5 is a rear view of the range finder archery sight hereof, mounted to the riser portion of the bow, illustrating further the manner by which the range pins cooperate to define the target.

To set the range pins 56, 56', such as illustrated in FIG. 5, the slide member includes a projecting adjustment arm 64, secured to slide member 24, such as by the end 66 seated within a slot, not shown, that allows the archer to quickly and easily move the slide member 24, manually up or down, until the respective range pins 56, 56' are set to the body of the game, i.e. top pin 56 on the back and bottom pin 56' on the belly. This establishes the range to the game, based on a preselected calibrated chip 46, and automatically centers the sight pin 60 on the target. As the arm 64 is pulled downward the arms 32, 32', carrying the range pins 56, 56', respectively, begin to close with the result that the biasing element stretches. Conversely, as the arms 56, 56' are caused to open, the biasing element 44 relaxes to help maintain the proper spacial relationship between the pair of range pins.

Finally, as seen in FIG. 5, the range finder archery sight 10 may include a pair of laterally projecting mounting arms 68, for mounting the device to the riser portion 70, of the bow, as known in the art. With the device so mounted and the archer poised for a "kill," the adjustment arm 62 is moved up or down until the respective range pins 56, 56' define the game, in the example of FIG. 5, a deer, with the upper pin 56 overriding the deer's back and the lower pin 56' aligned with the deer's belly. This manipulation of the range finder archery sight 10 automatically adjusts for the necessary trajectory of the arrow with the sight pin 60 aimed at the body of the deer.

While a preferred embodiment has been described above, it is recognized that variations may be had with respect to the components of this invention, such as the shape of the camming chip. Therefore, while the invention has been disclosed in a preferred form only, it will be obvious to those skilled in the art that many additions, deletions and modifications can be made therein without departing from the spirit and scope of this invention, and that no undue limits should be imposed thereon except as set forth in the following claims.

What is claimed is:

1. An adjustable range finder and sight for an archery bow, said range finder and sight, adapted for mounting to the bow above the grip thereof, comprising;

a.) a frame for fixedly mounting to said bow, said frame including a pair of vertically oriented guide members, where one of said guide members includes a cam guide arm;

b.) a slide member mounted for sliding movement between said member guide members;

i) a pair of pivotally mounted arms rotatably secured to said slide member, where said pivotally mounted arms include engaging means such that the counter clockwise movement of one said pivotal arm effects a clockwise movement of said second pivotal arm, each said arm mounting a range pin extending laterally from a remote end thereof;

ii) a removably replacable camming member mounted to said one pivotal arm and positioned to ride said cam guide arm to effect rotative movement of said pivotal arms during vertical movement of said slide member, iii) a sight pin fixedly mounted to said slide member and extending laterally between said pivotal arms and generally parallel to said range pins; and, c.) manual means to vertically adjust said slide, whereby to spacially change the distance between said range pins.

2. The adjustable range finder and sight according to claim 1, including a biasing means to counteract said manual means.

3. The adjustable range finder and sight according to claim 1, including adjustable means on said frame to limit the stroke legth of said slide member.

4. The adjustable range finder and sight according to claim 1, including mounting arms extending from said frame for removably securing said frame to said bow.

5. The adjustable range finder and sight according to claim 1, wherein said frame includes a top and a bottom which together with said guide members define a slot for said slide member.

6. The adjustable range finder and sight according to claim 1, wherein said engaging means comprise intermeshing gear teeth on the respective said pivotal arms.

7. In combination with an archery bow having a riser portion mouting a range finder and sight device, said device including a pair of range pins movable in a vertical direction to define a potential target, means to move said range pins in a plane toward and away from one another, and a fixed sight pin intermediately positioned between said range pins, where said intermediate position is independent of the vertical spacing between said range pins, a planar camming chip mounted on said means which move said range pins in a plane toward and away from one another, said chip including a camming edge movable along a cam rider post to effect a vertical spatial change in the relationship of said range pins.

8. The combination according to claim 7, wherein said camming chip is adjustable on said movable means.

9. The combination according to claim 7, wherein said camming chip is removably replacable.

* * * * *